US005973713A

United States Patent [19]

Kuwabara

[11] Patent Number: 5,973,713

[45] Date of Patent: Oct. 26, 1999

[54] THERMAL RECORDING APPARATUS

[75] Inventor: Takao Kuwabara, Kanagawa, Japan

[73] Assignee: Fuji Photo Film Co., Ltd., Kanagawa, Japan

[21] Appl. No.: 08/797,894

[22] Filed: Feb. 10, 1997

[30] Foreign Application Priority Data

Feb. 9, 1996 [JP] Japan ..... 8-024041

[51] Int. Cl.[6] ..... B41J 2/32

[52] U.S. Cl. ..... 347/194

[58] Field of Search ..... 347/194, 183, 347/184, 188, 195

[56] References Cited

U.S. PATENT DOCUMENTS 4,777,583 10/1988 Minami et al. ..... 347/208
4,916,560 4/1990 Kawaguchi ..... 360/73.09
5,204,704 4/1993 Genno et al. ..... 347/194

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

The improved thermal recording apparatus using a thermal head comprises an image processing unit which receives image data from an image supply source and which performs sharpness compensation and other image processing jobs on the received image data to construct data for the image to be recorded thermally and thermistor for measuring a temperature of the thermal head, wherein the image processing unit changes the coefficient of sharpness compensation in accordance with the temperature of the thermal head. The thermal recording apparatus can sufficiently reduce the drop in image sharpness due to an increased temperature of the thermal head and, optionally, the drop in image sharpness due either to an increased recording speed or to a reduced gamma value of the thermal material or to both factors to ensure the consistent production of unblurred, high-quality images.

10 Claims, 4 Drawing Sheets

THERMAL RECORDING APPARATUS

BACKGROUND OF THE INVENTION

This invention relates to the art of thermal recording apparatus using a thermal head.

Thermal recording materials comprising a thermal recording layer on a substrate such as a film, which are hereunder referred to as thermal materials, are commonly used to record the images produced in diagnosis by ultrasonic scanning.

This recording method, commonly referred to as thermal image recording, eliminates the need for wet processing and offers several advantages including convenience in handling. Hence, the use of the thermal image recording system is not limited to small-scale applications such as diagnosis by ultrasonic scanning and an extension to those areas of medical diagnoses such as CT, MRI and X-ray photography where large and high-quality images are required is under review.

As is well known, thermal image recording involves the use of a thermal head having a glaze in which heat-generating elements for heating the thermal recording layer of a thermal material to record an image are arranged in one direction and, with the glaze a little pressed against the thermal material (thermal recording layer), the thermal material is relatively moved in the auxiliary scanning direction perpendicular to the main scanning direction in which the glaze extends, as the respective heat-generating elements of the glaze are heated imagewise by energy application to heat the thermal recording layer, thereby accomplishing image reproduction.

Not only the thermal recording apparatus but also various other image recording apparatus including laser printers and plate-making apparatus are adapted to perform sharpness compensation in order to produce high-quality, clear and well modulated images by means of edge enhancement for improved image sharpness. In practice, however, the sharpness of recorded images is affected by various factors which, in the case of thermal recording, include the temperature of the thermal head, the recording speed (auxiliary scanning transport speed) and the gamma value of the thermal material used. Stated specifically, the image sharpness deteriorates with the increasing temperature of the thermal head (heat-generating elements) and with the increasing recording speed (the speed of movement of the thermal head relative to the thermal material) but with the decreasing gamma value of the thermal material and the recorded image will look blurred if these phenomena occur. More specifically, as for the recording speed, the image sharpness in the auxiliary scanning direction deteriorates with the increasing recording speed, and the image sharpness in the main scanning direction deteriorates with the decreasing recording speed, and the recording image will look blurred, if there phenomena occur. Among others, the increase in the temperature of the thermal head is most influential in the sharpness of the recorded image.

The reduced sharpness of the recorded image will lead to the deterioration of the quality of finished images and can be a serious problem in applications that require the recording of high-quality images. In the above-stated medical applications, images of particularly high quality are required and the reduction in sharpness is an obstacle to the viewing of the correct image, potentially leading to a wrong diagnosis.

SUMMARY OF THE INVENTION

The present invention has been accomplished under these circumstances and has as an object providing a thermal recording apparatus with which the drop in image sharpness due to an increased temperature of the thermal head and, optionally, the drop in image sharpness due either to an increased recording speed or to a reduced gamma value of the thermal material or to both factors can also be sufficiently reduced to ensure the consistent production of high-quality and well modulated images.

To achieve the above object, the invention provides a thermal recording apparatus comprising:

- an image processing unit which receives image data from an image supply source and which performs sharpness compensation and other image processing jobs on the received image data to construct data for the image to be recorded thermally;
- a thermal head having a glaze of which heat-generating elements are arranged in one direction, and are heated in accordance with said data for the image to be recorded thermally to perform image recording on a thermal recording material;
- means for moving the thermal recording material relative to the thermal head in a direction perpendicular to the direction in which said heat-generating elements are arranged, with the thermal recording material being kept in contact with said glaze; and
- means for measuring a temperature of the thermal head,
- wherein said image processing unit includes means for changing the coefficient of sharpness compensation in accordance with the temperature of the thermal head.

It is preferred that the thermal recording apparatus of the invention additionally has at least one means selected from the group consisting of means for detecting the recording speed, means for detecting the gamma value of the thermal recording material and means for setting the gamma value of the thermal recording material and said image processing unit has means for changing the coefficient of sharpness compensation in consideration of not only the temperature of the thermal head but also at least one of the recording speed and the gamma value of the thermal recording material.

It is also preferred that said means for changing the coefficient of sharpness compensation changes separately the coefficient of sharpness compensation in the direction in which said heat-generating elements are arranged, and the coefficient of sharpness compensation in the direction in which said thermal recording material is moved.

DETAILED DESCRIPTION OF THE INVENTION

The thermal recording apparatus of the invention will now be described in detail with reference to the preferred embodiments shown in the accompanying drawings.

Figure 1:
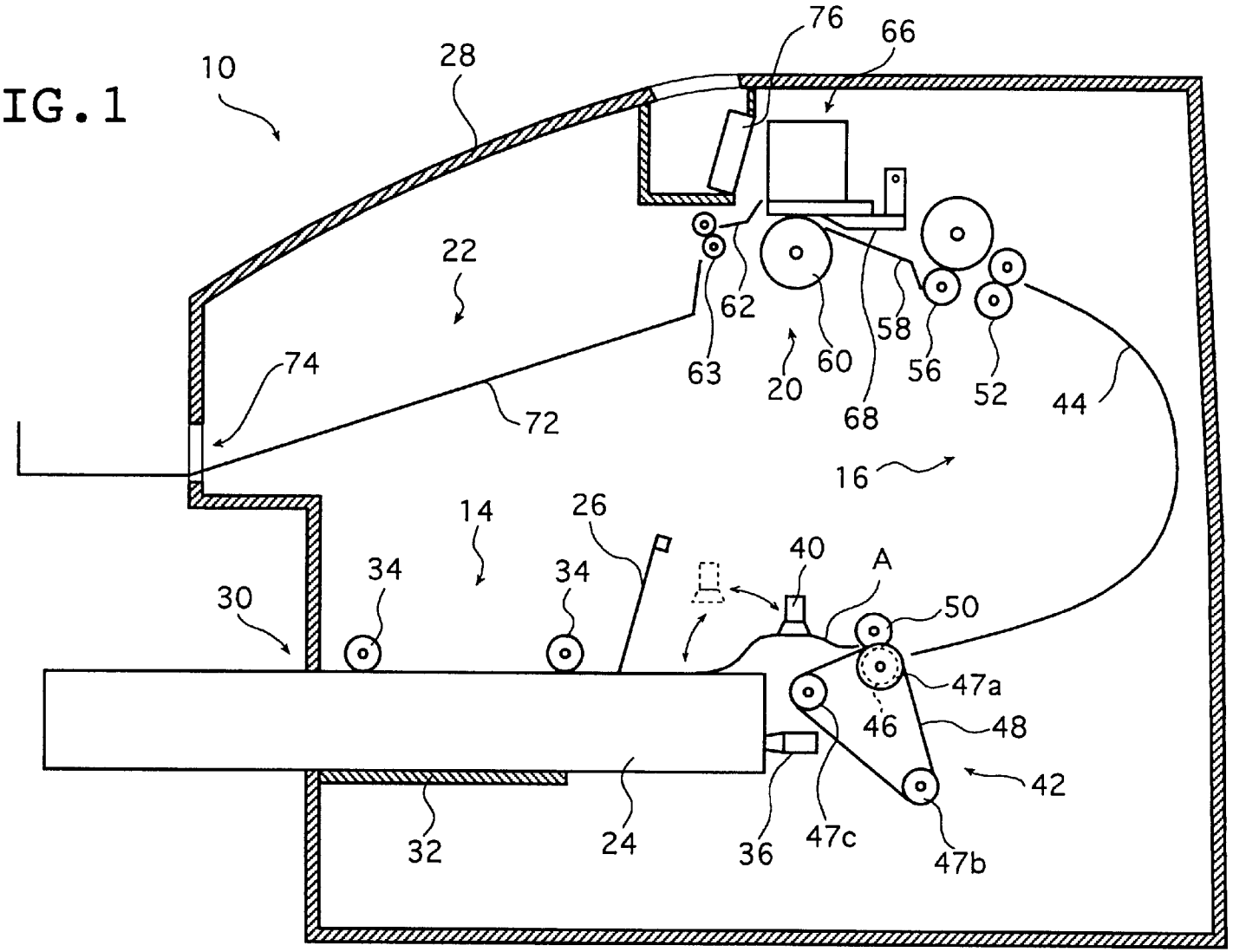
FIG. 1 shows the concept of a thermal recording apparatus according to an embodiment of the invention.

FIG. 1 shows schematically a thermal recording apparatus of the invention.

The thermal recording apparatus generally indicated by 10 in FIG. 1 and which is hereunder simply referred to as a "recording apparatus" performs thermal image recording on thermal recording materials of a given size, say, B4 (namely, thermal recording materials in the form of cut sheets, which are hereunder referred to as "thermal materials A"). The apparatus comprises a loading section 14 where a magazine 24 containing thermal materials A is loaded, a feed/transport section 16, a recording section 20 performing thermal image recording on thermal materials A by means of the thermal head 66, and an ejecting section 22. In addition, as shown in FIG. 3*b*, the thermal head 66 in the recording section 20 is connected to an image processing unit 80, an image memory 82 and a recording control unit 84, and the image processing unit 80 in turn is connected to a corrected data storage unit 86.

In the thus constructed recording apparatus 10, the feed/transport section 16 transports the thermal material A to the recording section 20, where the thermal material A against which the thermal head 66 is pressed is transported in the auxiliary scanning direction perpendicular to the main scanning direction in which the glaze extends (normal to the paper of FIG. 1 and indicated by arrow c in FIG. 3*b*) and in the meantime, the individual heat-generating elements are actuated imagewise to perform thermal image recording on the thermal material A.

The thermal materials A comprise respectively a substrate of film such as a transparent polyethylene terephthalate (PET) film, paper and the like which is overlaid with a thermal recording layer.

Typically, such thermal materials A are stacked in a specified number, say, 100 to form a bundle, which is either wrapped in a bag or bound with a band to provide a package. As shown, the specified number of thermal materials A bundled together with the thermal recording layer side facing down are accommodated in the magazine 24 of the recording apparatus 10, and they are taken out of the magazine 24 one by one to be used for thermal image recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10, via the inlet 30, cover 26 first; thereafter, the magazine 24 as it is guided by the guide plate 32 and the guide rolls 34 is pushed until it contacts the stop member 36, whereupon it is loaded at a specified position in the recording apparatus 10.

The feed/transport section 16 includes a sucker 40 for grabbing the thermal material A by application of suction, transport means 42, a transport guide 44 and a regulating roller pair 52 located in the outlet of the transport guide 44. The thermal materials A are taken out of the magazine 24 in the loading section 14 and transported to the recording section 20.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46. The forward end of the thermal material A which has been sheet-fed by means of the sucker 40 is pinched between the transport roller 46 and the nip roller 50 such that the material A is transported downstream.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). When the thermal material A has been pinched between the transport roller 46 and the nip roller 50, the sucker 40 releases the material, and the thus fed thermal material A is supplied by the transport means 42 into the regulating roller pair 52 as it is guided by the transport guide 44. When the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The advancing end of the thermal material A first reaches the regulating roller pair 52 by the transport means 42. The regulating roller pair 52 is normally at rest. The advancing end of the thermal material A stops here and is subjected to positioning.

When the advancing end of the thermal material A reaches the regulating roller pair 52, the temperature of the thermal head 66 (glaze 66*a*) is checked and if it is at a specified level, the regulating roller pair 52 start to transport the thermal material A, which is transported to the recording section 20.

Figure 2:
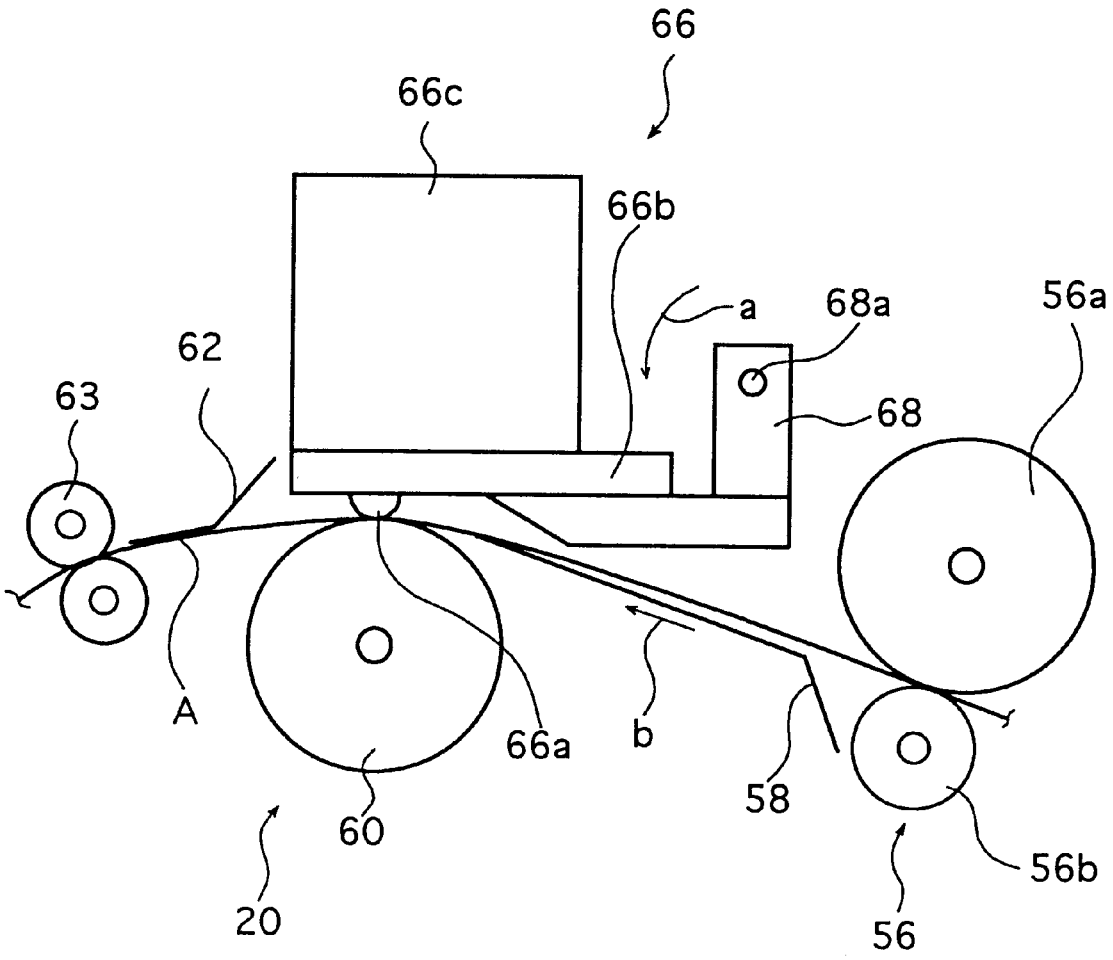
FIG. 2 shows the concept of the recording section of the thermal recording apparatus shown in FIG. 1.

FIG. 2 shows schematically the recording section 20.

The recording section 20 has the thermal head 66, a platen roller 60, a cleaning roller pair 56, a guide 58, a fan 76 for cooling the thermal head 66 (see FIG. 1) and a guide 62. The thermal head 66 is capable of thermal recording at a recording (pixel) density of, say, about 300 dpi. The head comprises a body 66*b* having the glaze 66*a* in which the heat-generating elements performing thermal recording on the thermal material A are arranged in one direction, that is in the main scanning direction (perpendicular to the paper of FIGS. 1, 2 and parallel to the direction of arrow c in FIG. 3), and a heat sink 66*c* fixed to the body 66*b*. The thermal head 66 is supported on a support member 68 that can pivot about a fulcrum 68*a* either in the direction of arrow a or in the reverse direction.

The platen roller 60 rotates at a specified image recording speed while holding the thermal material A in a specified position, and transports the thermal material A in the auxiliary scanning direction perpendicular to the main scanning direction (direction of arrow b in FIG. 2).

The cleaning roller pair 56 consists of an adhesive rubber roller 56*a* made of an elastic material and a nonadhesive roller 56*b*. The adhesive rubber roller 56*a* picks up dirt and other foreign matter that has been deposited on the thermal recording layer in the thermal material A, thereby preventing the dirt from being deposited on the glaze 66*a* or otherwise adversely affecting the image recording operation.

Before the thermal material A is transported to the recording section 20, the support member 68 in the illustrated recording apparatus 10 has pivoted to an UP position (in the direction opposite to the direction of arrow a) so that the thermal head 66 (or glaze 66*a*) is not in contact with the platen roller 60.

When the transport of the thermal material A by the regulating roller pair 52 starts, said material is subsequently pinched between the cleaning rollers 56 and transported as it is guided by the guide 58. When the advancing end of the thermal material A has reached a RECORD START position corresponding to a position directly beneath the glaze 66*a* as illustrated in FIG. 2, the support member 68 pivots in the direction of arrow a and the thermal material A becomes pinched between the glaze 66*a* on the thermal head 66 and the platen roller 60. The glaze 66*a* is pressed onto the recording layer while the thermal material A is transported in the auxiliary scanning direction b by means of the platen roller 60, the regulating roller pair 52 and the transport roller pair 63 as it is held in a specified position.

During this transport, the individual heat-generating elements on the glaze 66*a* are actuated imagewise to perform thermal image recording on the thermal material A.

The recording apparatus 10 of the invention performs thermal image recording with a coefficient of sharpness compensation that is altered in accordance with the temperature of the thermal head 66 and other relevant parameters in the manner described below.

Figure 3A:
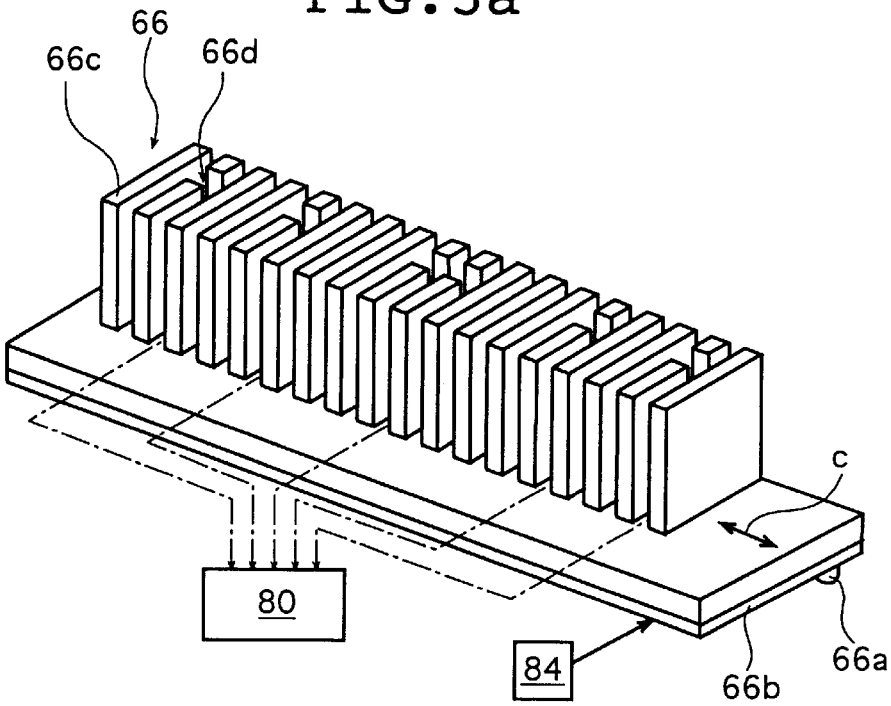
FIG. 3*a* is a schematic perspective view of the thermal head used in the recording apparatus.
Figure 3B:
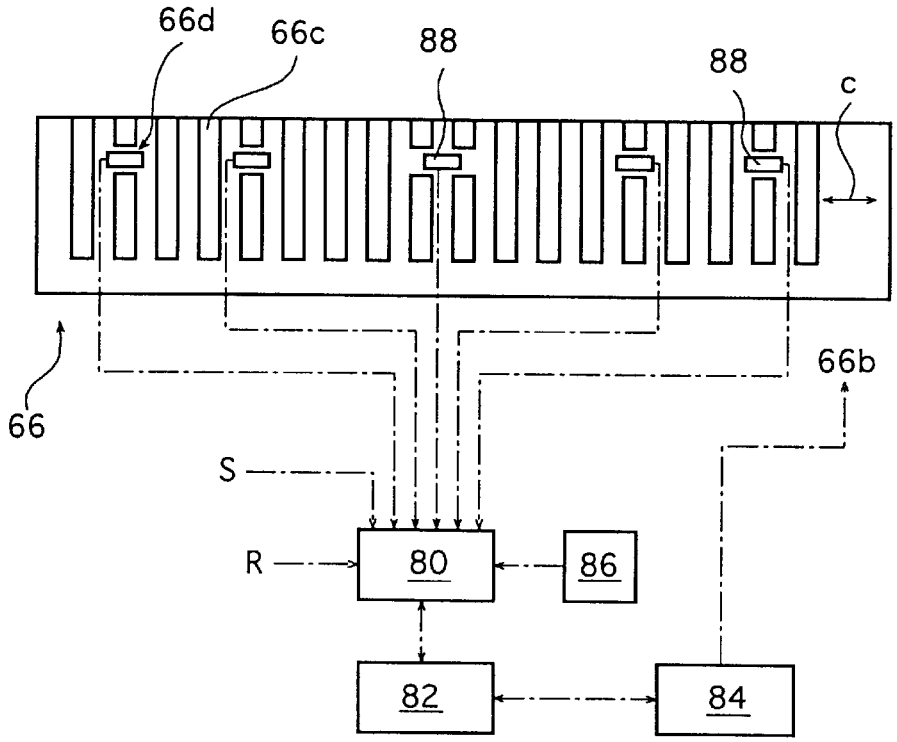
FIG. 3*b* is a block diagram of a system for controlling the recording with the thermal head.

FIG. 3*a* is a schematic perspective view of the thermal head 66 and FIG. 3*b* is a block diagram of the system for controlling the recording with the thermal head 66.

As FIG. 3*b* shows, the system for controlling the recording with the thermal head 66 is essentially composed of the image processing unit 80, image memory 82 and the recording control unit 84. The image processing unit 80 in turn is connected to the corrected data storage unit 86 for storing weighting functions or tables for the coefficient of sharpness compensation.

Image data from an image (data) supply source R such as CT or MRI is sent to the image processing unit 80.

The image processing unit 80 is the combination of various kinds of image processing circuits and memories. It receives the image data from the image supply source R and performs specified image processing jobs, such as sharpness compensation for edge enhancement, tone correction for producing an appropriate image in accordance with the gamma value and other characteristics of the thermal material A, temperature compensation for adjusting the energy of heat generation in accordance with the temperature of heat-generating elements, shading compensation for correcting the uneven density caused by the shape variability and other factors of the glaze 66*a* on the thermal head 66, resistance compensation for correcting the difference between the resistances of individual heat-generating elements, and black ratio compensation for ensuring that image data representing the same density will yield a color of the same density in spite of the variation in the drop of supply voltage to the thermal head due to the change in the pattern to be recorded. If necessary, the image processing unit 80 may perform formating (i.e., enlargement or reduction and frame assignment), whereupon the data for the image to be thermally recorded by means of the thermal head 66 is delivered as an output to the image memory 82.

As FIG. 3*b* shows, the fins of the heat sink 66*c* in the illustrated thermal head 66 have a cutout 66*d* formed at five sites of the area corresponding to the glaze 66*a* and thermistors 88 are provided at the base of the heat sink 66*c* at those sites. Each thermistor 88 detects the temperature of the glaze 66*a* by measuring the temperature of the base of the heat sink 66*c*; in the illustrated case, the temperature of the glaze 66*a* is detected in the five locations (i.e., the temperature of the heat-generating element in each of those locations is measured).

The results of temperature detection with thermistors 88 are sent to the image processing unit 80, which determines the temperatures of the individual heat-generating elements by a suitable method such as linear interpolation and performs the aforementioned temperature compensation on the basis of the thus determined temperatures.

It should be noted that in the recording apparatus 10 of the invention, not only is the temperature compensation effected but also the coefficient of sharpness compensation is corrected in accordance with the results of measurement of the temperature of the glaze 66*a* (or the heat-generating elements).

In a preferred embodiment of the recording apparatus 10, the image processing unit 80 may optionally be supplied with signals S for the recording speed, namely, the speed of transport by the platen roller 60 and the data on the gamma value of the thermal material A such that in addition to the temperature of the glaze 66*a*, the recording speed and/or the gamma value of the thermal material A is also taken into consideration for correcting the coefficient of sharpness compensation and preferably correcting the coefficient of sharpness compensation in the main scanning direction and/or in the auxiliary scanning direction in accordance with the recording speed, and the necessary sharpness compensation is performed using the thus corrected coefficients.

It is preferable to correct separate coefficients in the main and auxiliary scanning directions, in accordance with the recording speed, the temperature of the glaze 66*a* and the gamma value of the thermal material A, since the decrease in image sharpness is different in the main and auxiliary scanning directions.

While sharpness compensation can be performed by various known methods, a description of an exemplary procedure follows.

Assume that an image signal is dividable into n×n pixel signals $S_{ij}$ (i=1, 2, . . . , n; j=1, 2, . . . , n). Further assume that for each pixel signal $S_{ij}$, a pixel is written on a pixel line i at a jth position in the direction in which the glaze 66*a* extends. The first step of sharpness compensation is to convert the pixel signal $S_{ij}$ into a first unsharpness signal $U^1_{ij}$ which is an electrically blurred image signal.

The first unsharpness signal $U^1_{ij}$ is obtained by averaging the pixel signal $S_{ij}$ and the surrounding pixel signals as follows:

$$U^1_{ij} = \sum_{k=i-L}^{i+L} \sum_{m=j-L}^{j+L} S_{km} / M^2 \tag{1}$$

where M is the mask size, or the number of pixels used to construct the first unsharpness signal $U^1_{ij}$, and L is defined as (M−1)/2.

Then, the first unsharpness signal $U^1_{ij}$ is further averaged to calculate a second unsharpness signal $U^2_{ij}$. The second unsharpness signal $U^2_{ij}$ is calculated by the following equation:

$$U^1_{ij} = \sum_{k=i-L}^{i+L} \sum_{m=j-L}^{j+L} U^1_{km} / M^2 \tag{2}$$

The difference between the first unsharpness signal $U^1_{ij}$ and the second unsharpness signal $U^2_{ij}$ is multiplied by the coefficient of sharpness compensation K and added to the first unsharpness signal $U^1_{ij}$ (see the following equation 3) to produce a sharpness compensated pixel signal $S_{ij}$, $$S_{ij}=U^1_{ij}+K\cdot(U^1_{ij}-U^2_{ij}) \quad (3)$$

As already mentioned, the sharpness of a thermally recorded image is affected by the temperature of the thermal head 66 (or the heat-generating elements), the recording speed and the gamma value of the thermal material A. Specifically the sharpness of the recorded image decreases with the increasing temperature of the thermal head 66 and with the increasing recording speed but with the decreasing gamma value of the thermal material A.

To deal with this situation, the invention performs sharpness compensation by altering the relevant coefficient K in accordance with the temperatures of heat-generating elements that have been determined on the basis of the results of temperature detection with thermistors 88. In a preferred embodiment of the illustrated recording apparatus 10, in addition to the temperatures of the heat-generating elements, the recording speed and/or the gamma value of the thermal material A are taken into consideration in altering the coefficient K. Most preferably, effects of recording speed on the sharpness compensation in the main scanning direction and/or in the auxiliary scanning direction are also taken into consideration in altering the coefficient K to thereby perform the intended sharpness compensation.

As already mentioned, the image processing unit 80 is connected to the corrected data storage unit 86 for storing weighting functions or tables for the coefficient K.

Figure 4A:
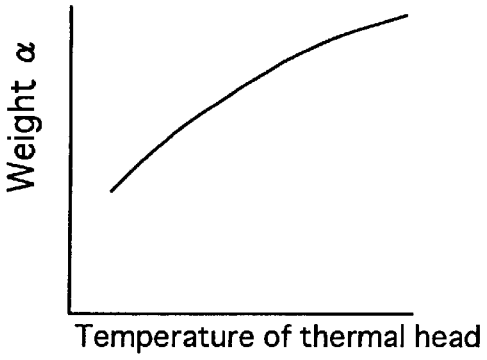
FIGS. 4*a*, 4*b*, 4*c* and 4*d* are graphs illustrating three weighting functions for the coefficient of sharpness compensation.
Figure 4B:
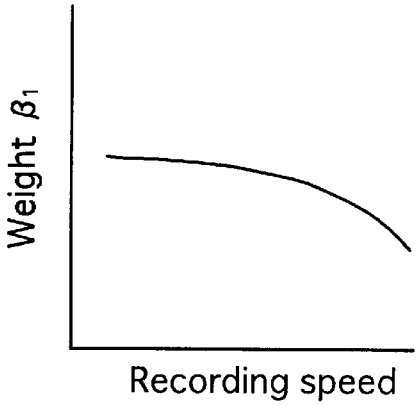
Figure 4C:
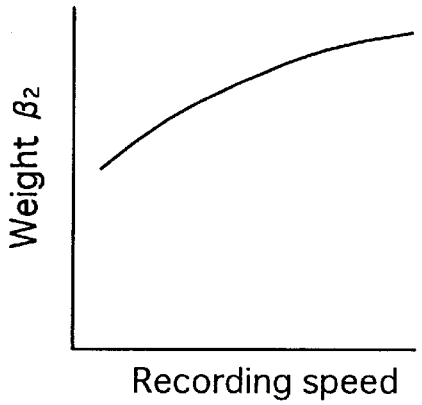
Figure 4D:
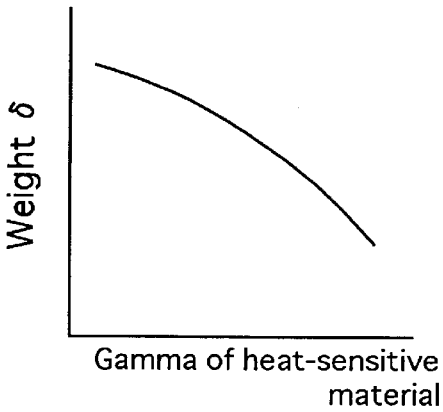

The corrected data storage unit 86 stores four kinds of weighting function (or corresponding tables). The first is used to calculate the weight $\alpha$ for obtaining the coefficient K corrected for the temperature of the thermal head 66 (or heat-generating elements) as shown in FIG. 4*a*. The second is used to calculate the weight $\beta_1$ for obtaining the coefficient K in the main scanning direction, corrected for the recording speed as shown in FIG. 4*b*, the third is used to calculate the weight $\beta_2$ for obtaining the coefficient K in the auxiliary scanning direction, corrected for the recording speed as shown in FIG. 4*c*. The fourth is used to calculate the weight $\delta$ for obtaining the coefficient K corrected for the gamma value of the thermal material A as shown in FIG. 4*d*.

On the basis of the detected temperatures of heat-generating elements, the image processing unit 80 in the process of sharpness compensation calculates (or reads out) the weight $\alpha$ using the function (or table) that is stored in the corrected data storage unit 86 and which is shown in FIG. 4*a* and multiplies a predetermined reference value of the coefficient K by the weight $\alpha$ to calculate the applicable value of K (=reference value×$\alpha$). The image processing unit 80 then performs sharpness compensation using the thus calculated coefficient K.

The recording apparatus 10 operates basically at a constant recording speed. Generally, the lower the recording speed, the higher the quality of the image produced and, conversely, rapid image recording can be realized by increasing the recording speed. If the recording apparatus is capable of operating in three modes, i.e., a normal-speed mode, a high-speed mode for performing rapid image recording, and a high-image quality mode in which low-speed recording is performed with a view to producing high image quality, the sharpness of the recorded image will deteriorate as the recording speed is increased.

In this case, the weighting functions (curves) associated with the recording speed which are respectively distinct in the main and auxiliary scanning directions may be previously stored in the corrected data storage unit 86, as shown in FIGS. 4*b* and 4*c*. A filtering may be effected for the main and auxiliary scanning directions using the separate coefficients of sharpness compensation.

That is, the image processing unit 80 employs the functions stored in the corrected data storage unit 86 which are shown in FIGS. 4*a*, 4*b* and 4*c*, and calculates not only the temperature-associated weight $\alpha$, but also at least one of the weights $\beta_1$ and $\beta_2$ respectively in the main and auxiliary scanning directions in accordance with the recording speed, multiplies separately the reference value of the coefficient K by the weights $\alpha$ and $\beta_1$ or $\beta_2$ to calculate separately the applicable values of K in the main and auxiliary scanning directions (K=reference value×$\alpha$×$\beta_1$, and reference value×$\alpha$×$\beta_2$), and performs separately the desired sharpness compensation in the main and auxiliary scanning directions using the calculated coefficients K.

It is preferred to adjust separately the coefficients K of sharpness compensation in accordance with the recording speed, using both of the weights $\beta_1$ and $\beta_2$ in the main and auxiliary scanning directions, but it is also possible to perform adjustment only using the one having a greater effect, or to use a weight previously calculated in consideration of the two weights.

Filtering of filter size 3 is described below as an example of the sharpness compensation effected using the coefficients of sharpness compensation separately calculated in the main and auxiliary scanning directions.

Assume that the respective coefficients of sharpness compensation in the main and auxiliary scanning directions for the image data of the pixels having number M in the main scanning direction, and pixels having number N in the auxiliary scanning direction are $K_m$ and $K_s$, respectively. Further assume that the image data before compensation and after compensation are respectively $D_{m,n}$ and $D_{m,n}$. In consideration of the pixel (m,n) (m=1−M, n=1−M), the sharpness compensation is effected in the main scanning direction, by the following equations:

$$K_{-1}=-K_m/2,\ K_0=1+K_m,\ K_1=-K_m/2$$

Then, the sharpness compensation is effected in the auxiliary direction, by the following equations:

$$K_{-1}=-K_s/2,\ K_0=1+K_s,\ K_1=-K_s/2$$

Thus, the sharpness compensation can be effected in a separate strength in the main and auxiliary scanning directions.

The gamma ($\gamma$) value of the thermal material A varies with humidity and the environment in which the recording apparatus 10 is installed and the image sharpness deteriorates with the decreasing gamma value.

Therefore, if the gamma value of the thermal material varies, the image processing unit 80 employs two of the functions stored in the corrected data storage unit 86 which are shown in FIGS. 4*a* and 4*d* and calculates not only the temperature-associated weight $\alpha$ but also the weight $\delta$ associated with the gamma value of the thermal material, multiplies the reference value of the coefficient K by the weights $\alpha$ and $\delta$ to calculate the applicable value of K (=reference value×$\alpha$×$\delta$), and performs the desired sharpness compensation using the calculated coefficient K.

If the recording speed and the gamma value of the thermal material are both expected to vary, the image processing unit 80 multiplies the reference value of K by all of the weights $\alpha$, $\beta_1$ or $\beta_2$ and $\delta$ to calculate the applicable values of K which are different in the main and auxiliary scanning directions (K=reference value×$\alpha$×$\beta_1$×$\delta$, and reference value×α×$\beta_2$×δ) and performs the desired sharpness compensation using the calculated coefficients K.

Thus, the recording apparatus 10 of the invention ensures that thermally recorded images of high quality that are free from any blur and which have satisfactory sharpness can be produced in a consistent manner irrespective of the temperature of the thermal head 66, and in a preferred case, even without regard to the recording speed and the gamma value of the thermal material A.

For effective operation of the recording apparatus 10, the weighting functions or tables for providing the weights α, $\beta_1$, $\beta_2$ and δ may be determined as appropriate for various factors including the characteristics of the thermal head 66 used, the characteristics of the thermal material A and the design specifications of the apparatus (e.g. heating and cooling efficiencies). If the adjusted coefficient of sharpness compensation exceeds a threshold value, either an undershoot or an overshoot will occur. To avoid this difficulty, the threshold value may be directly applied in sharpness compensation if it is exceeded by the adjusted coefficient K or, alternatively, the weighting functions or tables are preferably set in such a way that they will not exceed the associated threshold values.

When calculating the applicable values of the coefficient K by multiplying the reference value by the weight $\beta_1$ or $\beta_2$ associated with the recording speed, the method for detecting the recording speed is not limited in any particular way. If, as already noted above, the image recording apparatus 10 has three different operating modes, high-speed mode, normal-speed mode and high-quality image recording mode, the image processing unit 80 may detect the recording speed in accordance with the mode selected by the operator, or the recording speed may be entered by the operator, or, the speed of transport with the platen roller 60 may be detected by suitable means such as detection of pulses.

If the applicable value of the coefficient K is to be calculated by multiplying the reference value by the weight δ associated with the gamma value of the thermal material A, the latter may be entered by the operator, or alternatively, the image processing unit 80 may be so adapted that it calculates the gamma value of the thermal material A while it is effecting tone correction.

After the sharpness compensation, the image processing unit 80 performs other specified image processing jobs such as tone correction, temperature compensation, shading correction, resistance compensation and black ratio correction. Upon optional formating, image data is produced in association with the thermal recording to be done with the thermal head 66. These image data are delivered from the image processing unit 80 to be stored in the image memory 82.

The recording control unit 84 reads the stored image data sequentially out of the image memory 82 line by line in the direction in which the glaze 66*a* extends. The control unit 84 then supplies the thermal head 66 with a recording signal representing each of the thusly read image data (and represented by the duration of time for which voltage is applied imagewise).

The individual image recording dots on the thermal head 66 generate heat in accordance with the received recording signal and, as already described above, thermal image recording is performed on the thermal material A as it is transported in the direction of arrow b by such means of transport as the platen roller 60.

After the end of thermal image recording, the thermal material A, as it is guided by the guide 62, is transported by the platen roller 60 and a transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

On the foregoing pages, the thermal recording apparatus of the invention has been described in detail but the present invention is in no way limited to the stated embodiments and various improvements and modifications can of course be made without departing from the spirit and scope of the invention.

As described above in detail, the thermal recording apparatus of the invention is capable of reducing the drop in image sharpness due to an increased temperature of the thermal head and, preferably, it can also prevent the drop in image sharpness in the main and auxiliary scanning directions due to the increase in the recording speed and/or the decrease in the gamma value of the thermal material. The apparatus thusly has the advantage of producing unblurred, high-quality images in a consistent manner.

What is claimed is:

1. A thermal recording apparatus comprising:

an image processing unit which mathematically processes input image data according to a processing function including a coefficient of sharpness compensation to produce sharpness compensated data;

a thermal head coupled to said image processing unit, said thermal head having a glaze on which heat-generating elements are arranged in a main scanning direction, said heat-generating elements heated in accordance with said sharpness compensated data;

means for moving a thermal recording material relative to said thermal head in an auxiliary scanning direction which is perpendicular to said main scanning direction, such that said thermal recording material contacts said glaze; and means for measuring a temperature of said thermal head, said means for measuring coupled to said image processing unit;

wherein said image processing unit includes adjusting means for adjusting said coefficient of sharpness compensation in accordance with said temperature of said thermal head.

2. A thermal recording apparatus according to claim 1, further comprising:

means for detecting a recording speed coupled to said image processing unit;

wherein said adjusting means is for adjusting said coefficient of sharpness compensation in accordance with said recording speed.

3. A thermal recording apparatus according to claim 2, wherein said adjusting means is for adjusting said coefficient of sharpness compensation in accordance with said recording speed in said main scanning direction, and in said auxiliary scanning direction.

4. A thermal recording apparatus according to claim 1, further comprising:

means for detecting a gamma value of said thermal recording material coupled to said image processing unit;

wherein said adjusting means is for adjusting said coefficient of sharpness compensation in accordance with said gamma value of said thermal recording material.

5. A thermal recording apparatus according to claim 4, wherein said adjusting means is for adjusting said coefficient of sharpness compensation in accordance with said gamma value of said thermal recording material in said main scanning direction, and in said auxiliary scanning direction.

6. A thermal recording apparatus according to claim 1, wherein said adjusting means is for adjusting said coefficient of sharpness compensation in accordance with said temperature of said thermal head in said main scanning direction, and in said auxiliary scanning direction.

7. A thermal recording apparatus according to claim 1, further comprising:

means for inputting a recording speed coupled to said image processing unit;

wherein said adjusting means is for adjusting said coefficient of sharpness compensation in accordance with said recording speed.

8. A thermal recording apparatus according to claim 7, wherein said adjusting means is for adjusting said coefficient of sharpness compensation in accordance with said recording speed in said main scanning direction, and in said auxiliary scanning direction.

9. A thermal recording apparatus according to claim 1, further comprising:

means for inputting a gamma value of said thermal recording material coupled to said image processing unit;

wherein said adjusting means is for adjusting said coefficient of sharpness compensation in accordance with said gamma value of said thermal recording material.

10. A thermal recording apparatus according to claim 9, wherein said adjusting means is for adjusting said coefficient of sharpness compensation in accordance with said gamma value of said thermal recording material in said main scanning direction, and in said auxiliary scanning direction.

* * * * *